US005832679A

United States Patent [19]

Roth

[11] Patent Number: 5,832,679

[45] Date of Patent: Nov. 10, 1998

[54] APPARATUS FOR BRACING A STRUCTURAL COMPONENT AGAINST SWAY AND SEISMIC DISTURBANCES

[76] Inventor: Steven A. Roth, 12 La Homa Ct., Alamo, Calif. 94507-1407

[21] Appl. No.: 764,715

[22] Filed: Dec. 10, 1996

[51] Int. Cl.[6] ..... E02D 27/34

[52] U.S. Cl. ..... 52/167.3; 52/714

[58] Field of Search ..... 52/167.1, 167.3, 52/698, 712, 714; 248/200, 251

[56] References Cited

U.S. PATENT DOCUMENTS

| | | | |
|---|---|---|---|
| 1,816,226 | 7/1931 | Krabiel | 52/714 |
| 3,389,525 | 6/1968 | Moody | 52/714 |
| 3,748,815 | 7/1973 | Parker | 52/714 |
| 3,935,378 | 1/1976 | Heyden | 248/200 X |
| 3,939,619 | 2/1976 | Mason | 52/716 X |
| 4,065,218 | 12/1977 | Biggane | 52/167.3 X |
| 4,831,801 | 5/1989 | Stracke | 52/714 X |
| 5,170,974 | 12/1992 | Ruggiero | 248/251 |

FOREIGN PATENT DOCUMENTS

| | | | |
|---|---|---|---|
| 296727 | 12/1991 | Denmark | 52/714 |
| 2222425 | 11/1923 | Germany | 52/714 |
| 7614 | 10/1922 | Netherlands | 52/714 |

OTHER PUBLICATIONS

Tolco Incorporated Engineering Catalog published in Nov., 1994 p. 132 and identified as Fig. 910. Another related fitting illustrated in the same publication is a threaded side beam bracket shown in Fig. 58 thereof.

*Primary Examiner*—Carl D. Friedman
*Assistant Examiner*—Beth Aubrey
*Attorney, Agent, or Firm*—Thomas R. Lampe

[57] ABSTRACT

Apparatus for bracing a structural component against sway and seismic disturbances includes a strip structure having attachment portions for attaching the strip structure to a support and a threaded connector retention enclosure forming an enclosure interior. A threaded connector has an enlarged head located within the enclosure material and is for the purpose for receiving a threading bracing rod. The strip structure can be bent to change the angle of inclination of the rod.

15 Claims, 3 Drawing Sheets

APPARATUS FOR BRACING A STRUCTURAL COMPONENT AGAINST SWAY AND SEISMIC DISTURBANCES

TECHNICAL FIELD

This invention relates to the field of structural bracing. More particularly, the apparatus is a fitting used in association with other structural members to brace pipe or other structural components employed in buildings against sway and seismic disturbances.

BACKGROUND OF THE INVENTION

A variety of devices and techniques have been devised for bracing pipe and other structural components against sway and seismic disturbances. It is known to employ brace fittings of a specialized nature which receive an end of a pipe or rod, the latter extending between the pipe or other structural component and the building structure itself in order to provide bracing. One such commonly employed fitting is referred to as a swivel sway brace fitting which comprises a bracket and a threaded receptacle pivotally secured to the bracket by a bolt or other connector. The threaded receptacle receives the threaded end of an elongated bracing member such as a shaft or rod. An example of such a fitting is the swivel sway brace fitting illustrated on page 132 of the Tolco Incorporated Engineering Catalog published November, 1994 and identified as FIG. 910. Another related fitting illustrated in the same publication is a threaded side beam bracket shown in FIG. 58 thereof.

DISCLOSURE OF INVENTION

The apparatus of the present invention is a fitting for bracing pipe and other structural components against sway and seismic disturbances which is characterized by its simplicity, low cost and ease of usage as compared to prior art fittings employed for such purpose.

The apparatus of the present invention includes a sheet metal strip structure for attachment to a surface having a plurality of strip portions including a first attachment portion and a second attachment portion.

The sheet metal strip has a plurality of bends formed therein at spaced locations along the sheet metal strip structure. The first attachment portion and the second attachment portions are in face to face engagement.

The first attachment portion and the second attachment portion are for attaching the sheet metal strip structure to a surface. The sheet metal strip structure defines a threaded connector retention enclosure forming an enclosure interior and an aperture in communication with the enclosure interior.

The apparatus also includes a threaded connector having a connector body and an enlargement connected to the connector body. The connector body extends through the aperture of the sheet metal strip structure and projects outwardly of the sheet metal strip structure. The enlargement is located within the enclosure interior and prevented by engagement between the enlargement and the sheet metal strip structure from leaving the enclosure interior.

In a preferred embodiment of the invention, the sheet metal strip structure comprises two sheet metal strips, each of the sheet metal strips having two strip ends. One strip end of one of the sheet metal strips comprises the first attachment portion and one strip end of the other of the sheet metal strips comprises the second attachment portion.

In another embodiment of the invention, the sheet metal strip structure comprises a single sheet metal strip having two strip ends. Each of the strip ends is separated from the remainder of the single sheet metal strip by a bend. The first and second attachment portions are spaced from the strip ends where the first and second attachment portions are in face to face engagement.

Other features, advantages, and objects of the present invention will become apparent with reference to the following description and accompanying drawings.

BEST MODE FOR CARRYING OUT THE INVENTION

Figure 1:
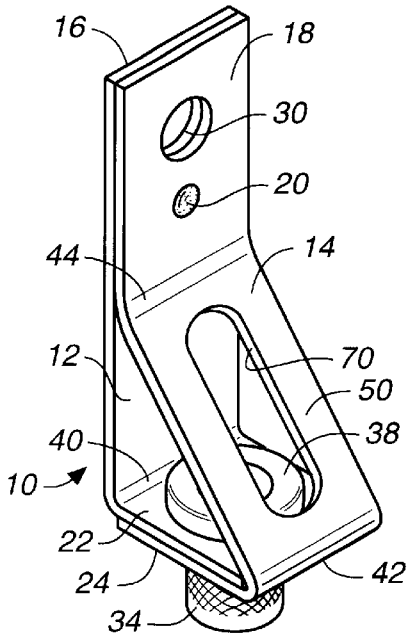
FIG. 1 is a perspective view of apparatus constructed in accordance with the teachings of the present invention.
Figure 2:
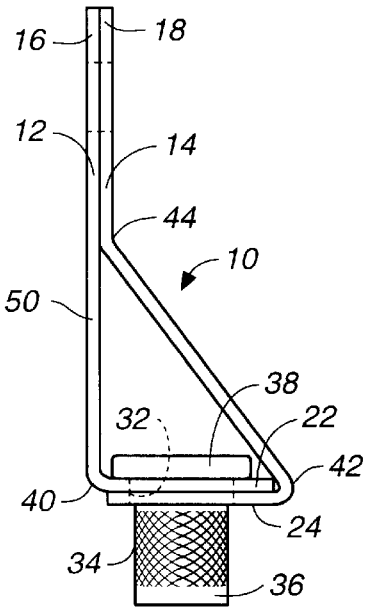
FIG. 2 is a side elevational view of the apparatus.

Referring now to FIGS. 1–4, apparatus constructed in accordance with the teachings of the present invention is generally designated by reference number 10. Apparatus 10 includes a strip structure formed from two sheet metal strips 12, 14. Each of the strips has two strip ends.

One strip end of strip 12 comprises an attachment portion 16 and one strip end of strip 14 comprises an attachment portion 18. Attachment portions 16, 18 are in face to face engagement and welded together by a spot weld 20.

The other ends of the strips, ends 22, 24, are also in face to face engagement. Ends 22, 24 of the strips are substantially orthogonally disposed relative to attachment portions 16, 18 when the apparatus is in its configuration shown in FIGS. 1 and 2, for example.

Attachment portions 16, 18 each define an opening, the openings being in registry as indicated by reference numeral 30. Strip ends 22, 24 cooperate to define an aperture 32 through which projects a threaded connector in the form of a nut 34 having a cylindrically-shaped connector body 36 and an enlargement 38. The threaded connector is movably mounted relative to the strip structure.

Bends 40, 42 and 44 are formed in the sheet metal strip structure whereby the sheet metal strip structure defines a threaded connector retention enclosure 50 which is in the shape of a right triangle, that portion of strip 14 between bends 42, 44 comprising the hypotenuse of the threaded connector retention enclosure.

Enlargement 38 is located within the enclosure interior defined by the threaded connector retention enclosure and is captured thereby and held in position by virtue of the fact that the hypotenuse portion of the triangular-shaped enclosure overlies the enlargement and prevents movement of the enlargement in an upward direction to such an extent that the lower end of the connector body will clear strip end 22.

Figure 3:
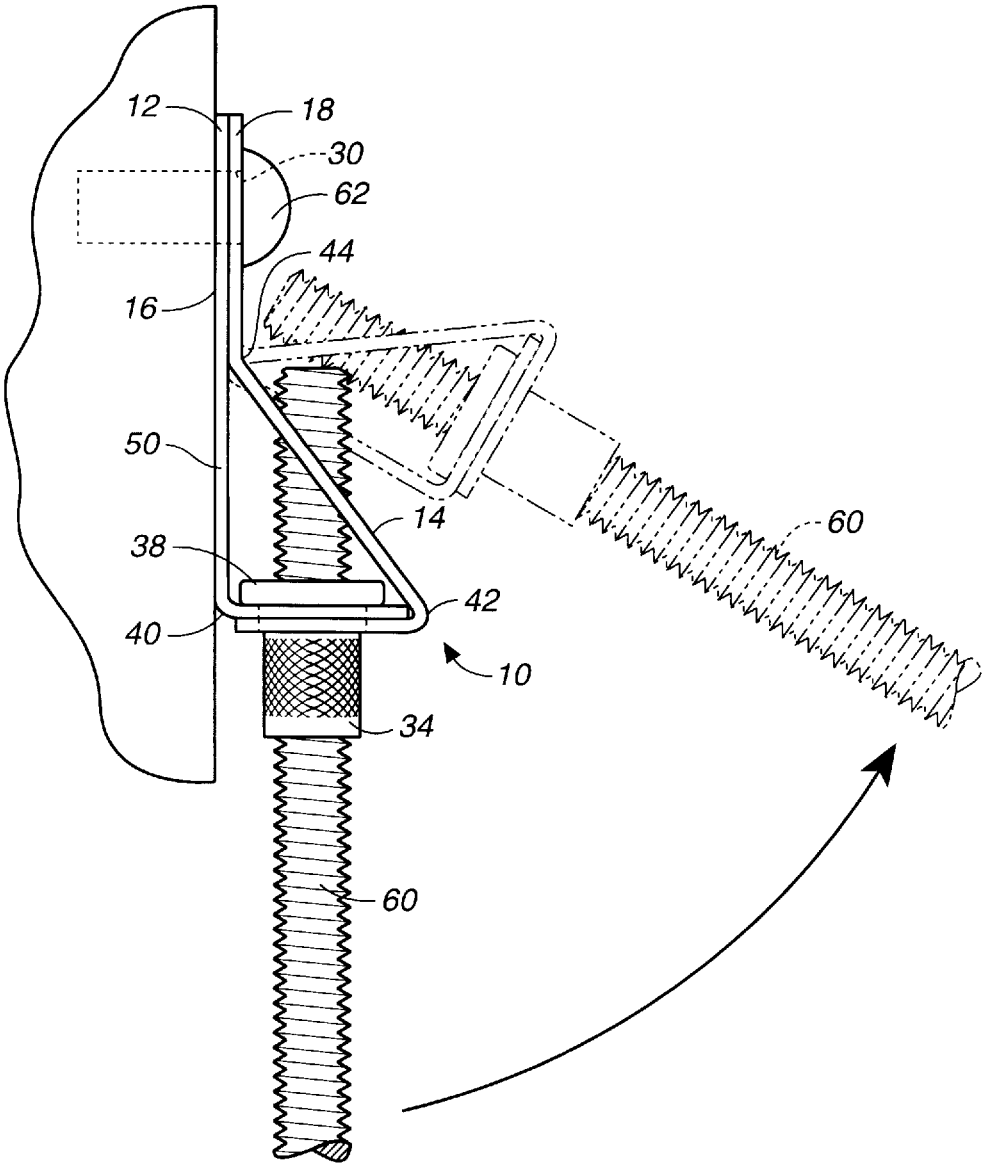
FIG. 3 is a side elevational view illustrating the apparatus attached to a wall surface and having an elongated threaded brace rod attached thereto, the apparatus and brace rod being shown in two different positions.
Figure 4:
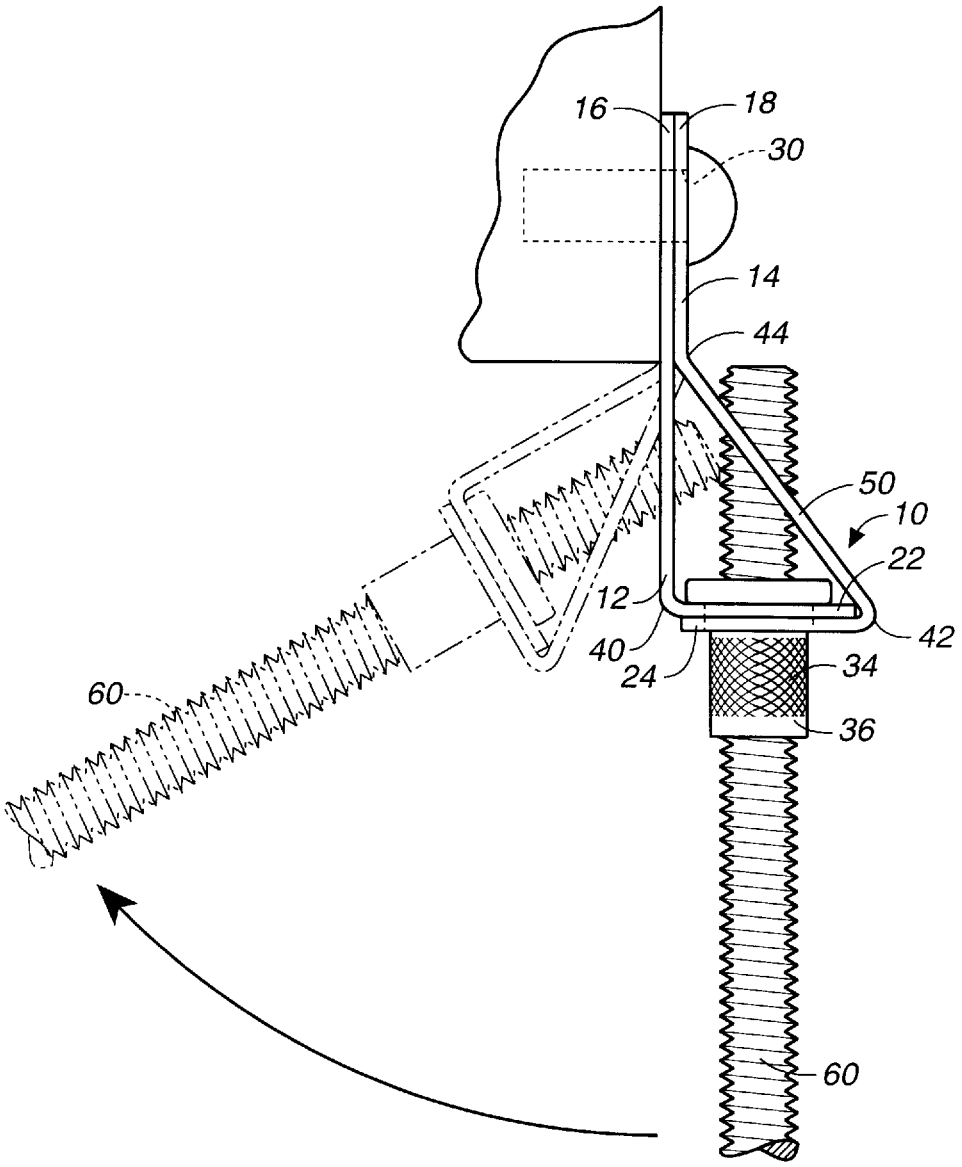
FIG. 4 is a view similar to that illustrated in FIG. 3 but showing the apparatus in a different operational environment.

Threaded connector or nut 34 is for receiving and for threaded engagement with an elongated brace member in the form of a threaded shaft or rod 60. FIGS. 3 and 4 illustrate a rod 60 threadably secured to the nut 34 and extending therethrough. It will be appreciated that the end of the rod not shown extends to and is secured in position at another location and that the rod acts as a bracing member between the two locations. Since the threaded connector is movably mounted on the strip structure, the threaded connector may be rotated to thread the threaded connector on the rod. Alternatively, the installer may choose to temporarily hold the threaded connector to prevent rotation thereof and instead rotate the rod.

FIG. 3 illustrates a mechanical fastener 62 such as a screw or nail passing through openings 30 defined by the attachment portions 16, 18. The end of the threaded rod not illustrated will, as stated above, extend to another location, for example to a pipe (not shown) that is to be braced.

The structure of the apparatus enables the inclination of the elongated brace member 60 to be adjusted, for example between the solid line position shown in FIG. 3 and the dash line position shown in that figure. This is accomplished by bending the apparatus where the threaded connector retention enclosure 50 adjoins the attachment portions, i.e., at the location of bend 44.

FIG. 4 illustrates the apparatus employed in a slightly different operational environment wherein the apparatus is attached to structure having a bottom surface. In this instance, the apparatus and rod are shown in dash lines being bent at bend 44 under such structure.

A slot or hole 70 is formed in that portion of the apparatus forming the hypotenuse of the threaded connector retention enclosure. Hole 70 allows passage of the threaded rod end therethrough and allows use of a longer threaded rod in a particular situation then would otherwise be the case.

Figure 5:
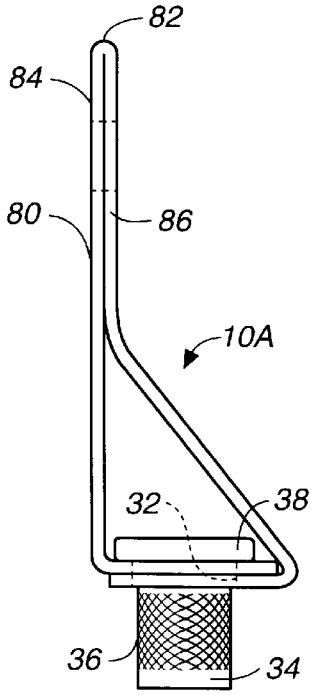
FIG. 5 is a side elevational view of an alternative embodiment of the apparatus

FIG. 5 illustrates an alternative embodiment of the invention. In this embodiment, the sheet metal strip structure of the apparatus 10A comprises a single sheet metal strip 80 including a fourth bend 82. Attachment portions 84, 86 proceed downwardly from bend 82 and are in face to face engagement. The ends of the strip are substantially orthogonally disposed relative to the attachment portions 84, 86, are in face to face engagement, and define the aperture through which nut 34 projects.

I claim:

1. An apparatus for bracing a structural component against sway and seismic disturbances, said apparatus comprising, in combination:

a strip structure for attachment to a surface having a first attachment portion and a second attachment portion, said strip structure having a plurality of bends formed therein at spaced locations along said strip structure, said first attachment portion and said second attachment portion being in face to face engagement, said first attachment portion and said second attachment portion for attaching said strip structure to a surface, and said strip structure being bent to define a threaded connector retention enclosure forming an enclosure interior and defining an aperture in communication with said enclosure interior; and a threaded connector having a connector body and an enlargement attached to said connector body, said connector body extending through the aperture of said strip structure and projecting outwardly of said strip structure, and said enlargement located within the enclosure interior and prevented by engagement between said enlargement and said strip structure from leaving the enclosure interior.

2. The apparatus according to claim 1 wherein said strip structure comprises two strips, each of said strips having two strip ends, one strip end of one of said strips comprising said first attachment portion and one strip end of the other of said strips comprising said second attachment portion.

3. The apparatus according to claim 2 wherein the strip ends that comprise said first and second attachment portions each define an opening, said openings being in at least partial registry for receiving a fastener for attaching said strip structure to a surface.

4. The apparatus according to claim 2 wherein said first and second attachment portions are welded together.

5. The apparatus according to claim 1 wherein said strip structure comprises a single strip having two strip ends.

6. The apparatus according to claim 5 wherein said strip ends are in face to face engagement and partially define said threaded connector retention enclosure, said aperture being located in said strip ends.

7. The apparatus according to claim 1 wherein said strip structure has a plurality of strip portions and wherein said threaded connector retention enclosure is triangular shaped and is comprised of at least three strip portions.

8. The apparatus according to claim 7 wherein said threaded connector retention enclosure is in the shape of a right triangle, one of said at least three strip portions comprising the hypotenuse of said threaded connector retention enclosure.

9. The apparatus according to claim 8 wherein said strip portion comprising the hypotenuse of said threaded connector retainer enclosure defines a hole.

10. The apparatus according to claim 1 wherein said threaded connector retention enclosure adjoins said attachment portions and is bendable relative to said attachment portions to change the orientation of said threaded connector retention enclosure relative to said attachment portions.

11. The apparatus according to claim 1 wherein said strip structure is formed from sheet metal.

12. The apparatus according to claim 1 wherein said threaded connector is rotatably mounted relative to said strip structure.

13. An apparatus for bracing a structural component against sway and seismic disturbances, said apparatus comprising:

a strip structure for attachment to a surface having a first attachment portion a second attachment portion, said strip structure having a plurality of bends formed therein at spaced locations along said strip structure, said first attachment portion and said second attachment portion being in face to face engagement, said first attachment portion and said second attachment portion for attaching said strip structure to a surface, and said strip structure being bent to define a threaded connector retention enclosure forming an enclosure interior and defining an aperture in communication with said enclosure interior, said strip structure for movably holding a threaded connector with at least a portion of said threaded connector located within the enclosure interior and prevented by engagement with said strip structure from leaving the enclosure interior.

14. An apparatus for bracing a structural component against sway and seismic disturbances, said apparatus comprising, in combination:

a strip structure for attachment to a surface having a first attachment portion and a second attachment portion, said strip structure having a plurality of bends formed therein at spaced locations along said strip structure, said first attachment portion and said second attachment portion being in face to face engagement, said first attachment portion and said second attachment portion for attaching said strip structure to a surface, and said strip structure being bent to define a threaded connector retention enclosure forming an enclosure interior and defining an aperture in communication with said enclosure interior; and a threaded connector movably mounted relative to said strip structure within the enclosure interior having a threaded interior in communication with the enclosure interior and prevented by engagement between said threaded connector and said strip structure from leaving the enclosure interior.

15. An apparatus for bracing a structural component against sway and seismic disturbances, said apparatus comprising, in combination:

a strip structure for attachment to a surface having at least one attachment portion, said strip structure having a plurality of bends formed therein at spaced locations along said strip structure, said at least one attachment portion for attaching said strip structure to a surface, and said strip structure being bent to define a threaded connector retention enclosure forming an enclosure interior; and a threaded connector movably mounted relative to said strip structure within the enclosure interior having a threaded interior in communication with the enclosure interior and prevented by engagement between said threaded connector and said strip structure from leaving the enclosure interior.

* * * * *